US005275023A

United States Patent [19]

Schindler

[11] Patent Number: 5,275,023

[45] Date of Patent: Jan. 4, 1994

[54] DEVICE ON A KNITTING MACHINE WITH SLIDER NEEDLES AND A SLIDER NEEDLE FOR KNITTING MACHINES

[75] Inventor: Hartmut Schindler, Albstadt, Fed. Rep. of Germany

[73] Assignee: SIPRA Patententwicklungs-und Beteiligungsgesellschaft m,b,H., Albstadt, Fed. Rep. of Germany

[21] Appl. No.: 876,879

[22] Filed: Apr. 30, 1992

[30] Foreign Application Priority Data

May 11, 1991 [DE] Fed. Rep. of Germany ..... 4115198

[51] Int. Cl.[5] ..... D04B 35/06

[52] U.S. Cl. ..... 66/120

[58] Field of Search ..... 66/120

[56] References Cited

U.S. PATENT DOCUMENTS

| | | | |
|---|---|---|---|
| 2,300,804 | 11/1942 | Peel et al. | 66/120 X |
| 4,210,003 | 7/1980 | Sqrillo et al. | 66/120 X |
| 4,317,343 | 3/1982 | Kohl | 66/120 |
| 4,570,459 | 2/1986 | Hägel | 66/120 |
| 4,584,852 | 4/1986 | Beck et al. . | |
| 4,637,228 | 1/1987 | Shima | 66/120 X |
| 5,035,124 | 7/1991 | Tibbals, Jr. | 66/120 |

FOREIGN PATENT DOCUMENTS

| | | | |
|---|---|---|---|
| 0357566 | 3/1990 | European Pat. Off. . | |
| 867575 | 7/1949 | Fed. Rep. of Germany | 66/120 |
| 2245731 | 3/1974 | Fed. Rep. of Germany | 66/120 |
| 2320789 | 11/1974 | Fed. Rep. of Germany | 66/120 |
| 3325767 | 11/1984 | Fed. Rep. of Germany . | |
| 3629791 | 3/1988 | Fed. Rep. of Germany . | |
| 3821213 | 2/1990 | Fed. Rep. of Germany . | |
| 2097952 | 5/1987 | Japan | 66/120 |
| 2184161 | 8/1987 | Japan | 66/120 |
| 1283027 | 7/1972 | United Kingdom . | |
| 1347154 | 2/1974 | United Kingdom . | |
| 2070075 | 9/1981 | United Kingdom | 66/120 |
| 2147917 | 5/1985 | United Kingdom . | |
| 2237035 | 4/1991 | United Kingdom . | |

OTHER PUBLICATIONS

GB 516025 of Dec. 20, 1939.

Groz-Beckert-Schiebernadeln (DIN 62 145, Teil 3) Kennbezeichnungen und Begriffe.

*Primary Examiner*—Clifford D. Crowder

*Assistant Examiner*—John J. Calvert

*Attorney, Agent, or Firm*—Michael J. Striker

[57] ABSTRACT

The invention relates to a device on a knitting machine equipped with slider needles for controlling the laying in of a thread (28) into the open needle hooks (5.2). In order to avoid that the thread is not laid into the hooks correctly or that a thread which has already been laid into the hook, jumps out of the hook (5.2) during the closing movement of the slider parts (6) on account of vibrations or the like, the slider parts (6) of the slider needles are provided with inclined faces (6.5) which project when the hooks (5.2) are closed into the thread spaces (32) formed by these hooks and the needle and slider parts (5,6). In this way the thread portions between the thread guide (29) and the slider needles are pressed deeply into the thread spaces (32) during the closing movement of the slider parts (6), so that the thread sections laid into the following slider needles with hooks still open come securely into the respective thread spaces (32) or are retained therein FIG. 3).

13 Claims, 4 Drawing Sheets

DEVICE ON A KNITTING MACHINE WITH SLIDER NEEDLES AND A SLIDER NEEDLE FOR KNITTING MACHINES

BACKGROUND OF THE INVENTION

The invention relates to a device on a knitting machine being equipped with slider needles having needle and slider parts, for controlling the laying in of a thread into thread spaces which are defined by the needle and slider parts as well as by hooks on the needle parts. The invention also relates to a slider needle for a knitting machine having such a device.

Devices on knitting machines equipped with slider needles for ensuring the laying in of the thread into the thread spaces provided therefor and defined in particular by the hooks of the needles are known. They consist of specially formed sinkers and associated cam tracks (DE-A1 3 629 791) and can additionally be combined with special thread guides (EP-A1 0 357 566). Such devices are needed especially with high-speed circular knitting machines equipped with slider needles. The reason is that slider needles do not, in contrast to latch needles, have any pivoted latches which could participate in the secure laying in of the thread into the thread spaces. Also the thread parts between the thread guides and still open thread spaces can flutter so strongly on account of changes in the thread tension or unavoidable vibrations of the knitting machine that they do not get laid into the thread spaces correctly or spring out of the thread spaces, even if already laid into them, during the closure thereof subsequently being effected with the slider parts.

The use of special sinkers and cam tracks is expensive in construction and not always desirable. This applies in particular in connection with high-capacity circular knitting machines, in which the possibility afforded by the slider needles of achieving high knitting speeds is to be fully exploited and in which accordingly any additional sinker movement and any additional sinker mass impede attainment of this object.

SUMMARY OF THE INVENTION

It is, therefore, an object of this invention to design the device of the kind referred to above in such a manner that no special sinkers or sinker movements are needed to protect the laid-in thread. A further object of this invention is to guarantee that the threads are safely laid into the thread spaces without the use of additional sinkers and to avoid that threads already having been laid into the thread spaces can spring out of the thread spaces during closure thereof. Yet another object of this invention is to design a slider needle in such a manner that the objects mentioned above are solved without the need of additional sinkers, sinker movements or the like.

According to this invention, a device on a knitting machine which is equipped with slider needles having needle and slider parts movable relative to one another, for controlling the laying in of a thread into thread spaces provided therefor and which are defined by the needle and slider parts as well as hooks on the needle parts and are closed and opened by at least partial movement of the slider parts relative to the needle parts, is formed by inclined faces of the slider parts and presses the thread deeper into the thread spaces when the slider part is moved to close the hook.

The slider needle according to this invention has a needle part provided with a shank having a back and a hook connected thereto, and a slider part having a shank section and a closing section connected thereto, for opening and closing the hook. The closing section is provided on its back side with an inclined surface sloping up in the direction of the shank section and in the direction of the back of the needle part. The slider part is arranged movably in its longitudinal direction relative to the needle part for at least partial closing of the hook. The hook, the shank and the closing section, in the closed condition of the hook, define a thread space for laying in a thread. The inclined surface which presses the thread into the thread space when the slider part is moved to close the hook.

The invention provides for an advantage in reliable laying in of the thread into the thread spaces and preventing the thread jumping out of the thread spaces by specially formed slider parts. Accordingly neither special sinkers nor sinker movements are needed, nor do additional movements of the slider parts have to be provided. Since the mass of the slider parts is in any case increased insignificantly by the presence of the inclined surfaces, the advantage of higher knitting speeds desired with the use of slider needles can be utilised to the full.

Slider needles with slider parts having inclined faces are already known in principle (DE-C1 3 325 767). The known inclined faces do not however serve the purpose of affecting the thread actively but merely to produce a gradual transition from the comparatively wide shanks of the slider parts to their comparatively slender closing sections. Such inclined faces are therefore neither suitable for nor intended to solve the problem of the invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Slider needles, circular knitting machines equipped with the same and their functioning or manner of operation are generally known (DE-A1 3 821 213, DE-A1 3 629 791, EP-A1 0 357 566) and do not need to be explained in more detail here. It is obvious that, in this respect, knitting machines can be provided which operate optionally in single mode technology (knit), dual mode technology (knit, miss) or three-mode technology (knit, miss or tuck) and are optionally provided with sinkers, which can in addition execute movement parallel to the movement of the needle and/or slider parts or not.

Figure 1:
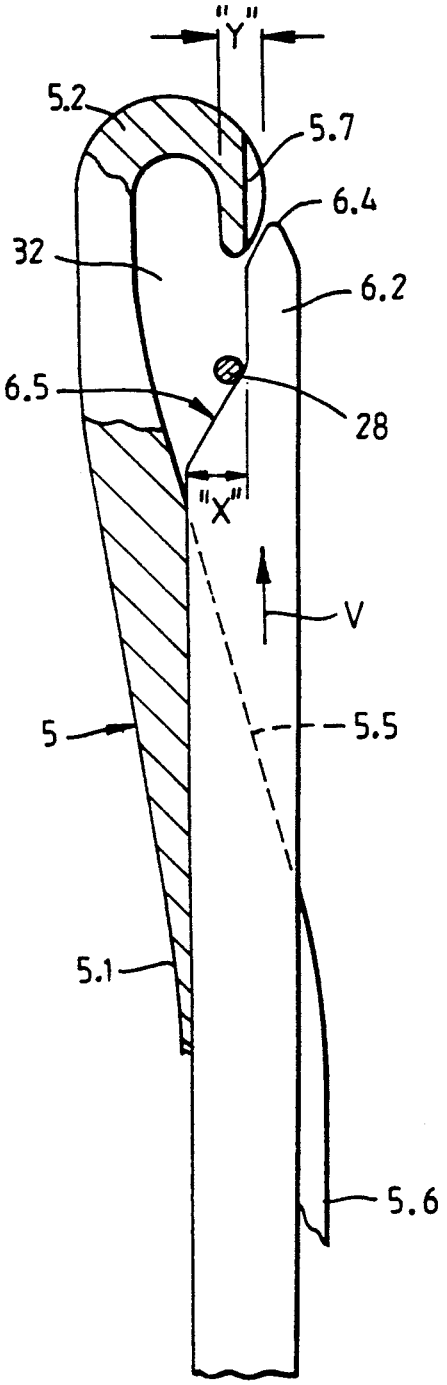
FIGS. 1 and 2 are partially sectioned side views, greatly enlarged, of a slider needle according to a first embodiment of the invention with the thread space partially opened and closed respectively.
Figure 2:
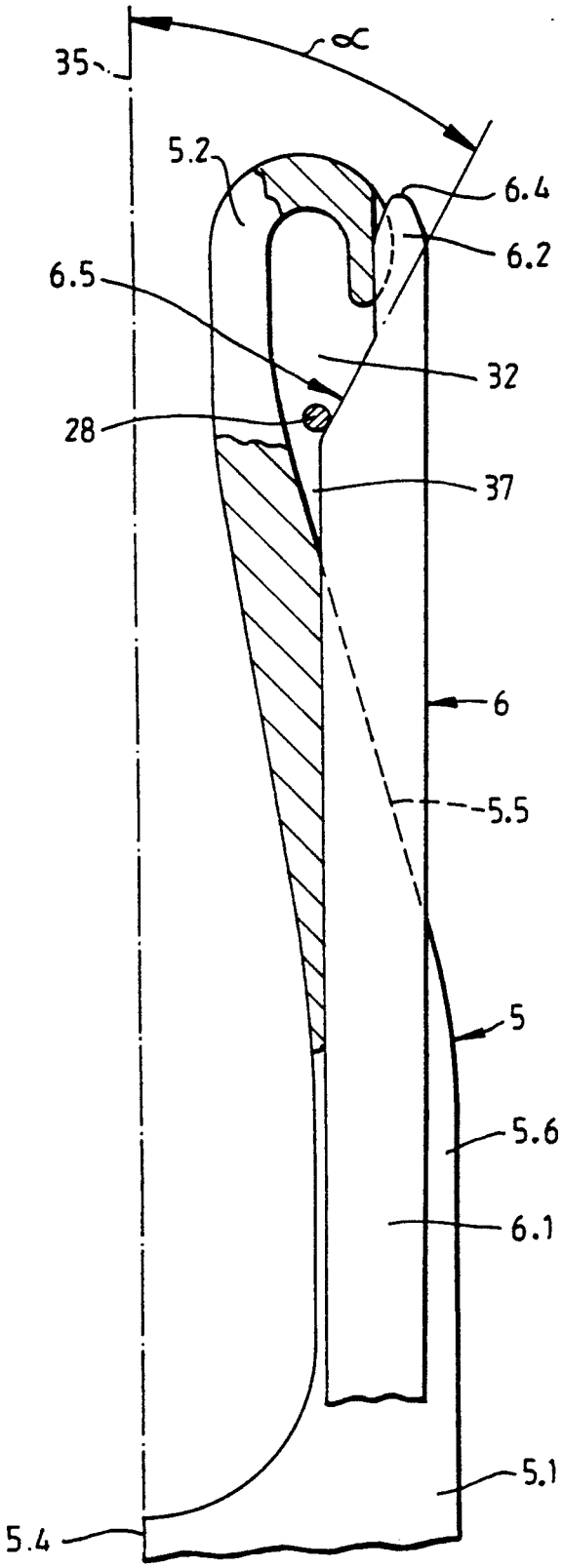

According to FIGS. 1 and 2, slider needles consist of needle parts 5 with shanks 5.1 and hooks 5.2 and slider parts 6 with shank sections 6.1 and closing sections 6.2, which are adapted to open and close the hooks 5.2 or the thread spaces formed thereby. The needle and slider parts 5, 6 also have butts controlled by cam parts in known manner.

Figure 3:
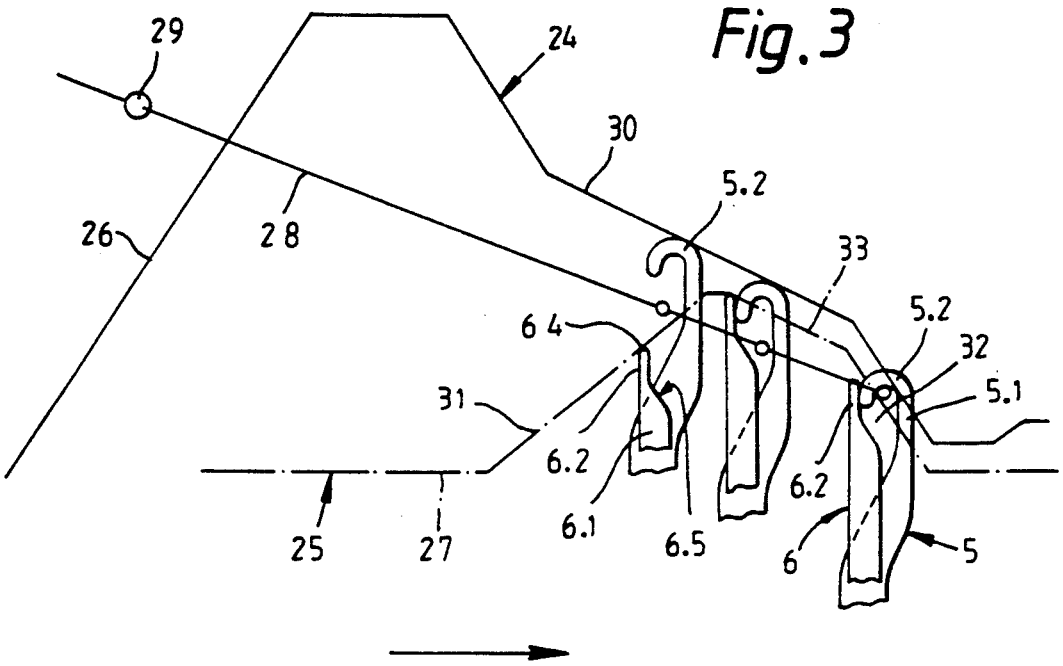
FIGS. 3 and 4 are highly schematic and simplified diagrams of the principle underlying the invention, to facilitate reliable laying in of the thread or to prevent the thread already laid into the thread spaces of the slider needles jumping out with the aid of special slider parts, namely in a partial perspective front view and a partial plan view of the needle circle of a circular knitting machine.
Figure 4:
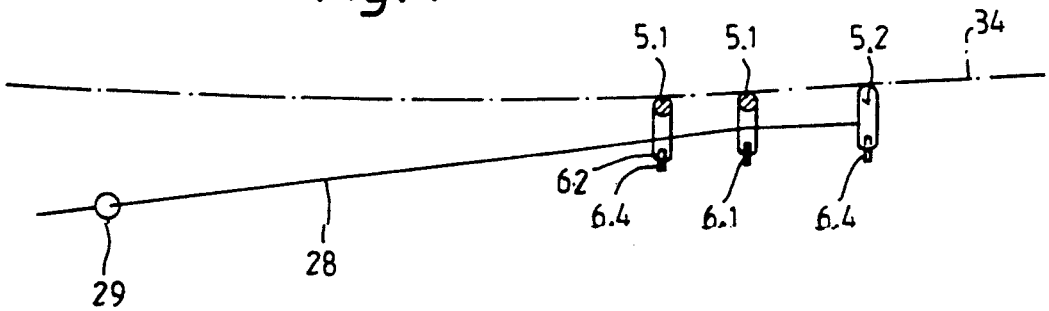

FIGS. 3 and 4 show schematically and by way of example those paths 24 and 25 which the upper edges of the hooks 5.2 and the extreme tips 6.4 of the closing sections 6.2 respectively traverse when the butts of the needles or slider parts are guided in the corresponding cam tracks of a system, the direction of travel of the slider needles being indicated in FIGS. 3 and 4 by an arrow B. The needle parts 5 are firstly guided on a rising advancing section 26 while the slider parts 6 are guided on a substantially horizontal section 27. The hooks 5.2 are thereby opened and raised to such a height that they are above a thread 28, which is fed in known manner by means of a thread guide 29 in the vicinity of the advancing section 26. Following this the needle parts 5 are guided on a falling retraction section 30 and at the same time the slider parts 6 are guided on a rising advancing section 31, as is shown in FIGS. 3 and 4 for the left-most slider needle. This results on the one hand in the thread 28 getting into the region of the hook 5.2 and on the other hand the closing section 6.2 gradually closing the hook 5.2 or a thread space 32 enclosing the thread 28 in known manner, this space being essentially delimited by the hook 5.2, the shank 5.1 and the closing section 6.2. This operation is concluded in FIGS. 3 and 4 at the middle slider needle. Then the slider part 6 moves on a track section 33 running parallel to the retraction section 30, as is shown in FIGS. 3 and 4 for the slider needle at the extreme right, so that a new loop can be made from the thread 28 in known manner with the hook 5.2 closed. During these described operations the slider needles are guided with a back 5.4 on an arc 34 in accordance with FIG. 4 determined by the diameter of the needle cylinder and which corresponds to the bottom (line 35 in FIG. 2) of the needle tricks 4 and thus the position of the backs 5.4 of the slider needles.

The track sections 26, 27, 30, 31 and 33 can each have the shape appropriate to the type of knitting machine involved.

As is apparent from FIG. 3, the hook 5.2 of the right needle in FIG. 3, in which not only is the thread space 32 closed but the thread 28 is already arranged in the hook 5.2 and thereby positioned, has a relatively large spacing from the thread guide 29. Due to this and due to the unavoidable vibrations in high-capacity knitting machines, there is the danger that this thread part, which is arranged between the right slider needle and the thread guide 29, will begin to flutter or swing. Accordingly the tips 6.4 of following needles, e.g. the left slider needle in FIG. 3, could stick into the thread 28 on rising up or the threads 28 could even get in front of the tips 6.4, so that they are not disposed in the thread space 32 after conclusion of the closing operation and so form a dropped stitch.

The circular knitting machine shown in FIGS. 3 and 4 has a structurally simple device for avoiding this problem. It is formed by inclined faces 6.5 on the closing sections 6.2 of the slider parts 6. The faces are apparent in FIGS. 1 and 2 also and face the thread space 32, with the object of pressing the thread 28 deeper into the thread space 32 during the closing movement of the closing section 6.2, moving it as close as possible to the immediate vicinity of the shank 5.1. This is indicated in FIGS. 3 and 4 by a black dot for the middle slider needle and has the result that the thread comes to lie more securely in the thread space 32 of at least one following slider needle, that on the left in FIGS. 3 and 4, and stays there also during the following closing movement of the associated slider part 6. FIG. 4 thus shows in the region of the left and the middle slider needle a section through the needle part 5 at approximately the level of the dark dot according to FIG. 3, while in the case of the right needle a plan view is shown. Accordingly in FIG. 4 the shank 5.1 at the left is shown in section and the shank section 6.1 with the closing section 6.2 and the tip 6.4 in plan view. For the middle needle there are shown sections both through the shank 5.1 and through the shank section 6.1 closely beneath the inclined face 6.5. For the right needle the hook 5.2 and the tip 6.4 of the closing section 6.2 can be seen. Moreover FIG. 4 shows that the thread 28 has a slight kink in the region of the middle needle, since it is pushed completely radially inwards by the inclined face 6.5 and is thus so positioned and damped that the thread cannot swing any longer in this middle slider needle therefore there is no danger for the slider needle to the left in FIG. 4 that the thread 28 will get into a position outside the tip 6.4 during the closing movement of its closing section 6.2.

The location, steepness, width and length of the inclined face 6.5 do not depend only on the geometry of the slider needle in the particular application but also on various other factors, especially on how rapidly the advance of the slider parts 6 along the track section 31 takes place in comparison with the retraction of the needle part 5 along the track section 30. Accordingly the inclined face 6.5 is always to be so formed that it presses the thread 28 sufficiently deeply into the thread space 32 and thus operates actively thereon in the part of the closing movement effected by the slider parts 6.

FIGS. 1 and 2 show the slider needle greatly enlarged, the bottom of the associated tricks in the needle bed being indicated by the line 35 (FIG. 2), on which the shank 5.1 is guided by its back 5.4 in a sliding fit. A comparison of FIGS. 1 and 2 shows clearly that the thread 28 runs on to the inclined face 6.5 facing the shank 5.1 or the back 5.4 at the beginning of the closing movement taking place in the direction of an arrow V and then slides along this inclined face 6.5 and is thus moved radially by an amount "X" (FIG. 1), i.e. in the direction of the shank 5.1 or the back 5.4. The amount "X" preferably corresponds to at least a hook width "Y" (FIG. 1), so that the thread 28 comes into position sufficiently deep in the thread space 32.

As is further apparent from FIGS. 1 and 2, a needle breast 5.5 can be provided between the hook 5.2 and the shank 5.1 steeply rising in opposite sense to the inclined face 6.5 and the shank section 6.1 of the slider parts 6 can be mounted slidably in a U-shaped longitudinal groove 5.6 of the needle part 5. Moreover the free end of the hook 5.2 can be provided in known manner with a further longitudinal groove 5.7, into which the closing section 6.2 is guided with the hook 5.2 closed. The inclined face 6.5 is preferably straight as in FIGS. 1 and 2, although bowed, stepped and other inclined faces could be provided, and forms an angle $\alpha$ with the back 5.4 of preferably 15° to 70°. With the hook 5.2 closed, the start of the inclined face 6.5 preferably lies directly at the free hook end (FIG. 2), while the end of the inclined face 6.5 is preferably arranged close above the breast 5.5 or between this and the hook 5.2 and in particular projects inwardly beyond the inner edge of the hook 5.2 in the direction of the back 5.4. Accordingly the angle $\alpha$ (FIG. 2) is to be chosen on the one hand so that the inclined face 6.5 can effect a sufficiently large stroke in the direction of the back 5.4 but it is on the other hand not selected so large that the thread 28 is merely pushed up in the thread space 32.

Figure 5:
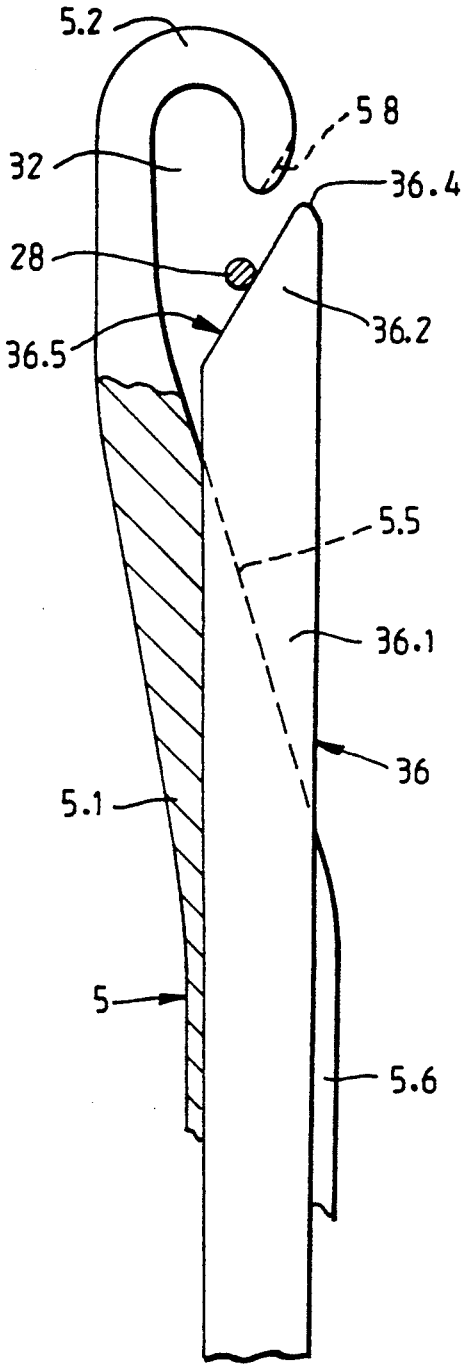
FIGS. 5 and 6 are views corresponding to FIGS. 1 and 2 of a slider needle according to a second embodiment of the invention.
Figure 6:
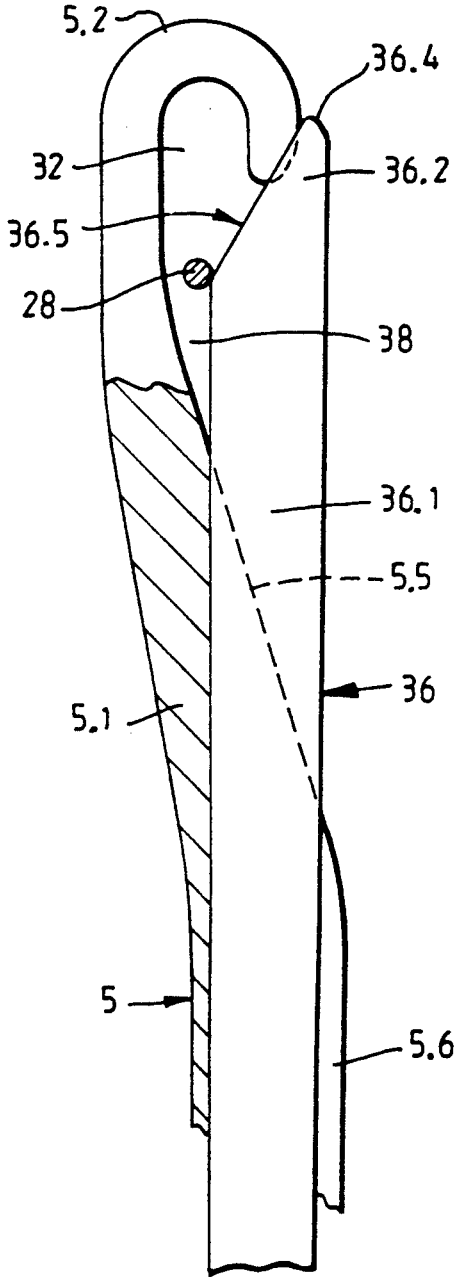

While the inclined face 6.5 begins in the closed hook 5.2 closely below its free end in the embodiment according to FIGS. 1 and 2 and in a middle section of the closing section 6.2, the embodiment according to FIGS. 5 and 6, in which the same parts are given the same reference numerals, has a slider parts 36 with a modified closing section 36.2. This is provided with an inclined face 36.5 extending over practically the whole of its width, so that it is not stepped as in FIGS. 1 and 2 but is shaped essentially as a wedge or triangle. Accordingly the hook 5.2 has no longitudinal groove 5.7 parallel to the back 5.4 of the needle part 5 (FIG. 1 and 2) but a groove 5.8 (FIG. 5) which makes with the back of the needle part 5 an angle corresponding to that of the inclined face 36.5. With the hook 5.2 closed a part of the inclined face 36.5 itself is arranged in the groove 5.8, rather than a part located above the same.

The parts 36.1 and 36.5 correspond to the parts 6.1 and 6.4 of the slider needle according to FIGS. 1 and 2.

Figure 7:
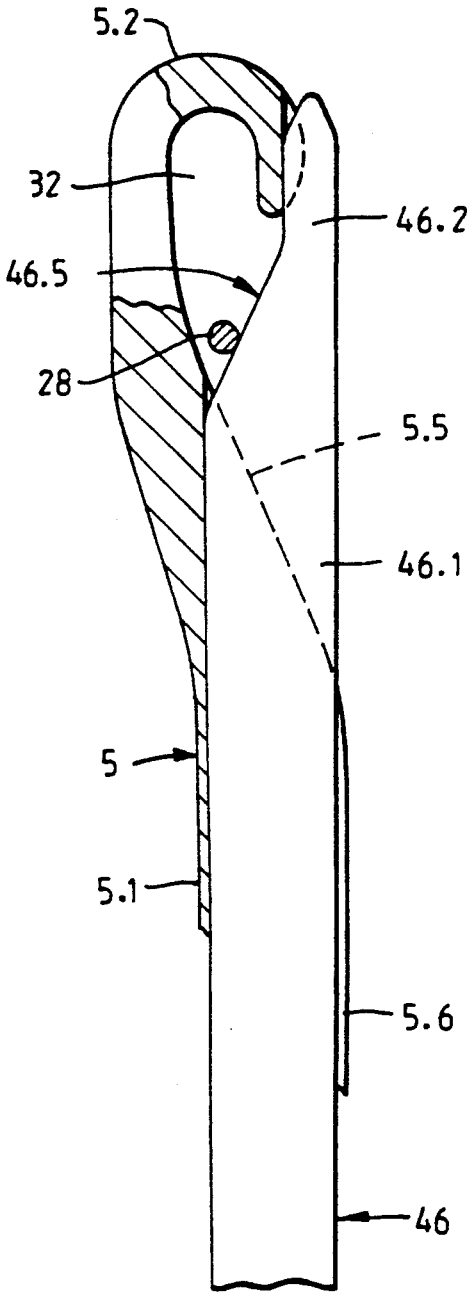
FIG. 7 is a view corresponding to FIG. 2 of a slider needle according to a third embodiment of the invention.

The embodiment of FIG. 7, in which the same parts are again given the same reference numerals, differs from the embodiment according to FIGS. 1 and 2 essentially in a slider part 46 with a prolonged inclined face 46.5, with the result that both the amount "X" (FIG. 1) and also the width of the shank section 46.1 of the slider part 46 are increased relative to FIGS. 1 and 2. This has the advantage that the inclined face 46.5 extends in the closed state of the hook 5.2 up to the longitudinal groove 5.6 of the needle part 5, i.e. dips into the needle breast 5.5, and that accordingly the free spaces 37 or 38 visible in FIGS. 2 and 6 cannot occur below the inclined face 46.5 and between the shank 5.1 of the needle part 5 and the shank section 46.1 of the slider parts 46.

Figure 8:
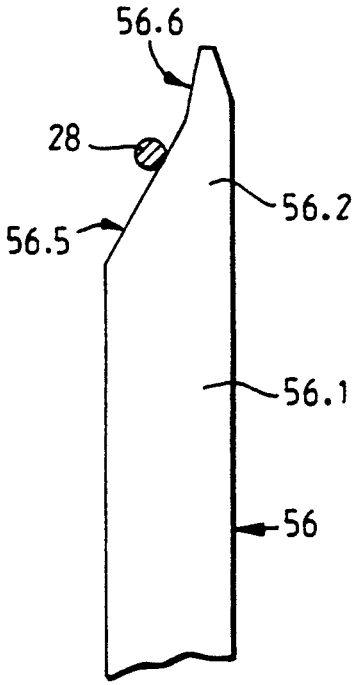
FIG. 8 the slider part of a slider needle according to a fourth embodiment of the invention.

FIG. 8 finally shows a slider part 56 with a shank section 56.1 which includes a closing section 56.2 provided with an inclined face 56.5. In contrast to FIGS. 1, 2 and 7 the inclined face 56.5 adjoins a further inclined face 56.6 towards the free end of the closing section 56.2, making an angle with the inclined face 56.5 and cooperating in the closing operation with a correspondingly formed groove in the hook of a needle part formed as in FIGS. 1 to 7. Both inclined faces 56.5 and 56.6 can then be formed in accordance with current requirements.

As is apparent from FIGS. 1, 2 and 5 to 8, the thread 28 can be pushed into the thread space 32 an amount "X" on closing the hook 5.2 of any slider needle with the aid of the inclined faces 6.5, 36.5, 46.5 and 56.5. In this way, not only is the thread part lying between this slider needle and the thread guide 29 steadied but it is also so guided that it is retained in or restrained against jumping out of the still open thread space 32 of at least one following slider needle or even the still open thread spaces 32 of a plurality of following slider needles. In this way still more slider needles, not shown in FIGS. 3 and 4, could be arranged between that slider needle, which corresponds to the middle slider needle in FIGS. 3 and 4, at which the incline face has attained its full effect, and that slider needle, which corresponds to the left needle in FIGS. 3 and 4, at which the thread just enters the thread space, depending on the steepness of the track sections 30, 31 or the like. The slider parts and their inclined faces of these additional needles assume intermediate positions.

Moreover the invention is not restricted to the described embodiments, which can be modified in many ways. This apples especially in relation to the slider needles themselves, where the expression slider needle is to comprehend all similarly functioning needles, especially such as are sometimes formed as or designated tubular or compound needles. Moreover it is immaterial whether a circular knitting machine, a flat knitting machine or another knitting or fashioning machine is involved in a particular application. Furthermore it is obvious that it is not necessarily every slider needle of a knitting or fashioning machine which has to have the described inclined face, since a comparable action can also be achieved if for example only every second slider part were to be provided with such an inclined face. However, in the embodiment considered to be best all slider parts are provided with the described inclined face. Finally it is immaterial whether only the slider parts or, as in FIG. 3, the needle parts also are moved in order to close the thread spaces.

I claim:

1. A knitting machine having slider needles comprising needle and slider parts, said needle parts having hooks and backs and said slider parts having closing sections, said slider parts being slidably mounted with said needle parts and movable relative to one another; and means for controlling laying in a thread into thread spaces by pressing the thread in a direction of the needle backs when the slider parts are moved to close the hooks, said thread spaces defined by said needle and said slider parts and said hooks, the spaces being closable and openable by at least partial movement of said slider parts relative to said needle parts, said closing section having inclined surfaces extending at an angle of 15° to 70° with respect to the back of the shank which form said means for controlling so as to press a thread into the thread spaces when said slider parts are moved to close said hooks.

2. A knitting machine according to claim 1, wherein said hooks have a width measured in a direction transverse to an axis of said slider needles, said inclined surfaces being formed to displace the thread transverse to said axis by at least half the width of said hooks during closing of said hooks.

3. A knitting machine according to claim 1, wherein said inclined surface runs along a plane.

4. A knitting machine according to claim 1, wherein said needle part has a shank with a back, said inclined surface, making an angle of 15° to 70° with said back of said shank.

5. A knitting machine according to claim 1, wherein said needle part is provided with a breast, said inclined surface having an end arranged substantially between said breast and said hook closed.

6. A knitting machine according to claim 1, wherein said inclined surface begins directly at a free end of said hook when said hook is closed.

7. A knitting machine according to claim 1, wherein said needle part has a shank with a back, said inclined surface having an end which projects, when said hook is closed, inwardly beyond an inner edge of said hook in a direction of said back of said needle part.

8. A slider needle for knitting machines, comprising a needle part provided with a shank having a back and a hook, and a slider part having a shank section and a closing section for opening and closing the hook; and means for controlling laying in of a thread by pressing the thread into a thread space by an inclined surface of the slider part when said slider part is moved to close the hook, said closing section being provided with a back side extending in an inclined surface sloping up in a direction from said shank section and in a direction away from said back of said needle part, said slider part having a longitudinal direction and being arranged movably in said longitudinal direction relative to said needle part for at least partial closing of said hook, said hook, said shank and said closing section in a closed condition of said hook defining a thread space for laying in a thread, said inclined surface being formed to extend at an angle of 15° to 70° with respect to the back of the shank to press the thread into said thread space when said slider part is moved to close said hook.

9. A slider needle according to claim 8, wherein said hooks have a width measured in a direction transverse to an axis of said slider needle, said inclined surfaces being formed to displace the thread transverse to said axis of said slider needle by at least half of the width of said hook during closing of said hook.

10. A slider needle according to claim 8, wherein said inclined surface runs along a plane.

11. A slider needle according to claim 8, wherein said needle part is provided with a breast said inclined surface having an end arranged substantially between said breast and said hook with said hook closed.

12. A slider needle according to claim 8, wherein said inclined surface begins directly at a free end of said hook (5.2) when said hook is closed.

13. A slider needle according to claim 8, wherein said inclined surface has an end which projects, when said hook is closed, inwardly beyond an inner edge of said hook in a direction of said back of said needle part.

* * * * *